United States Patent [19]

Spaeth et al.

[11] Patent Number: 4,790,730

[45] Date of Patent: Dec. 13, 1988

[54] HEATABLE DIAPHRAGM PUMP FOR GASES

[75] Inventors: Tilman Spaeth, Ernatsreute; Eberhard Lembcke, Überlingen, both of Fed. Rep. of Germany

[73] Assignee: Bodenseewek Geratetechnik GmbH, Fed. Rep. of Germany

[21] Appl. No.: 155,231

[22] Filed: Feb. 12, 1988

[30] Foreign Application Priority Data

Feb. 14, 1987 [DE] Fed. Rep. of Germany ..... 3704700

[51] Int. Cl.[4] ..... F04B 35/00; F04B 39/06; F04B 21/04; H05B 11/00

[52] U.S. Cl. ..... 417/373; 417/313; 417/413; 219/201; 92/1

[58] Field of Search ..... 417/413, 313, 373; 219/200, 201, 528, 535; 166/62, 272; 92/1; 222/146.5

[56] References Cited

U.S. PATENT DOCUMENTS

| | | | |
|---|---|---|---|
| 3,947,154 | 3/1976 | Klepp | 417/373 |
| 3,953,401 | 4/1976 | Gabler | 528/495 |
| 4,016,185 | 4/1977 | Wilkes | 562/547 |
| 4,580,037 | 4/1985 | Muller | 222/146.5 |
| 4,601,457 | 7/1986 | Austin | 92/1 |

*Primary Examiner*—Carlton R. Croyle
*Assistant Examiner*—Robert Blackmon
*Attorney, Agent, or Firm*—Lee & Smith

[57] ABSTRACT

Deposits and corrosion are to be avoided in a heatable diaphragm pump for smoke gases which are to be analyzed. A heatable pump head comprises a diaphragm chamber which is closed by a diaphragm. The diaphragm is driven by a motor through a connecting rod. The connecting rod is heated by controlled heating means and a temperature sensor. Transmission of measuring signals from the temperature sensor to a controller and the power supply to the heating means is permitted through U-shaped leaf springs.

13 Claims, 1 Drawing Sheet

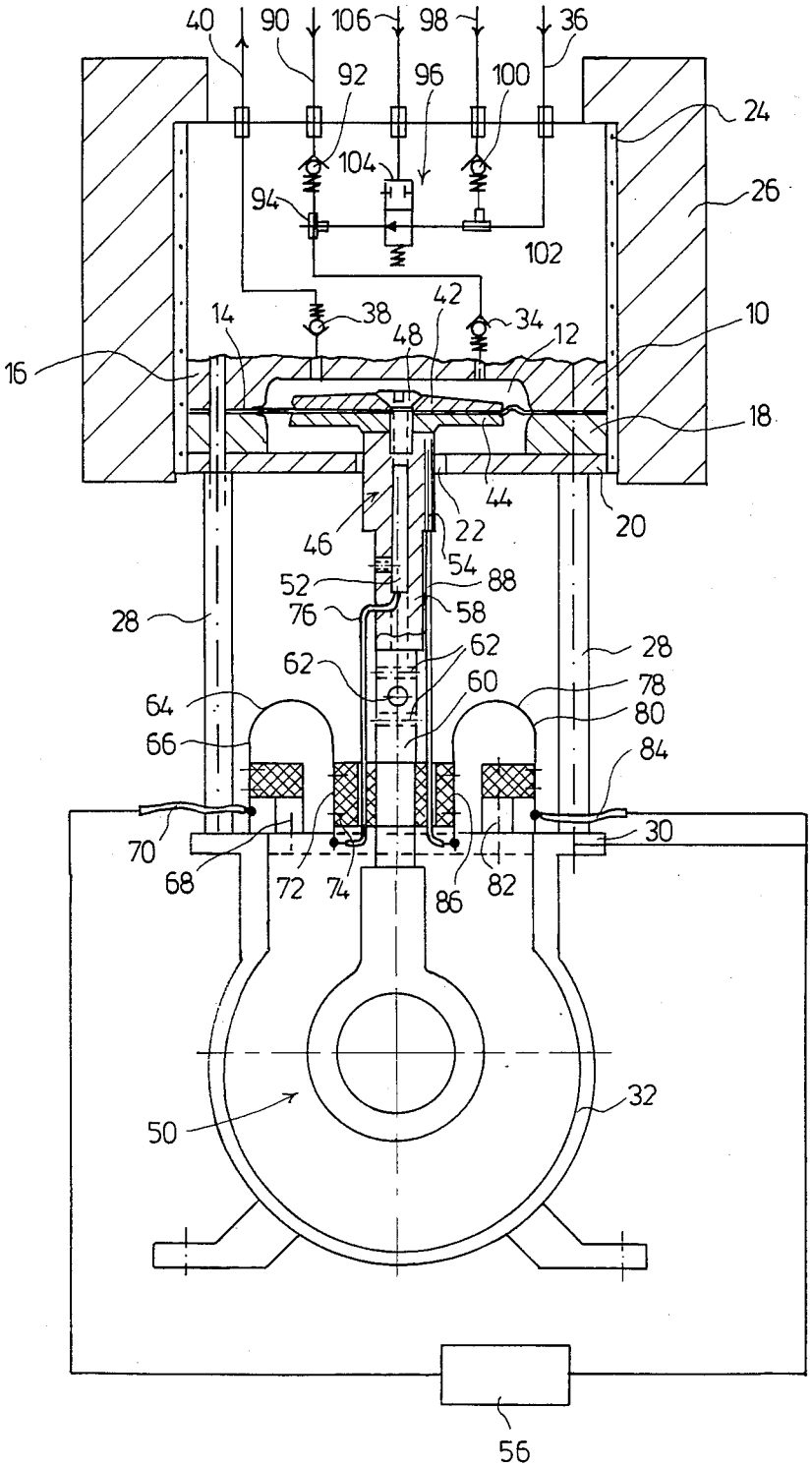
40
90
106
98
36
92
96
100
24
104
26
94
102
42
14
38
34
10
48
12
16
18
44
20
46
22
54
52
88
76
58
28
28
62
62
60
78
64
80
66
84
70
30
68
72
74
86
82
32
50
56

HEATABLE DIAPHRAGM PUMP FOR GASES

The invention relates to a heatable diaphragm pump for gases, for example for the pumping of smoke gases which are to be analysed for noxious components, comprising (a) a pump head with a diaphragm chamber which is closed by a flexible diaphragm and which communicates with a gas inlet through a check valve opening in inlet direction, and communicates with a gas outlet through a check valve opening in outlet direction, (b) a driving motor (c) a connecting rod which is fixedly connected to the diaphragm through clamping plates and which is arranged to be driven for reciprocatory motion by the driving motor through a crank drive, (d) insulation means for thermic insulation of the pump head, and (e) pump head heating means for heating the pump head Such diaphragm pumps are known for pumping smoke gases which are to be analysed for noxious components. Known diaphragm pumps comprise a pump head with a diaphragm chamber which is closed by a PTFE-diaphragm. The pump head is surrounded by pump head heating means. A heat insulation layer is arranged around the pump head heating means. Furthermore the pump head is held on studs at a distance from a driving motor. The heat insulation layer and the studs form insulation means for thermal insulation of the pump head. The diaphragm pump is driven by the driving motor through a crank drive and a connecting rod. The connecting rod is fixedly connected to the diaphragm through clamping plates. The driving motor runs at a speed of 1500 rpm, such that the connecting rod reciprocates and the diaphragm oscillates at 25 cycles per second.

The heating of the pump head is to prevent the temperature from dropping below the dew point of the smoke gases.

The prior art diaphragm pumps of this kind showed that deposits and corrosion occured despite of the heating and resulted in failure of the diaphragm pump in many cases. Smoke gas compositions with $SO_2$, $SO_3$ and $NH_3$ turned out to be particularly critical.

It is the object of the invention to prevent the described deposits and corrosion phenomena in the diaphragm pump of the above defined type.

The invention is based on the investigation and discovery of the reason of this undesired phenomenon. The invention is based on the discovery that the deposit and corrosion phenomena observed are due to insufficient heating of the clamping plate. Only the housing of the pump head is heated. The clamping plates are connected to this pump head only through the PTFE-diaphragm. PTFE is a poor heat conductor. On the other hand heat is dissipated through the connecting rod. Consequently the clamping plates are too cold. Such cold locations cause deposits and corrosion because smoke gas components precipitate there.

According to the invention the object mentioned above is achieved in that (f) heating means are provided in the connecting rod in addition to the pump head heating.

Thereby cold locations mentioned are avoided. It has been found that thereby also the mentioned deposit and corrosion phenomena are avoided.

Modifications of the invention are subject matter of the sub-claims.

An embodiment of the invention will now be described in further detail with reference to the accompanying drawing.

BRIEF DESCRIPTION OF THE DRAWING

The FIGURE is a side elevation view of a heated diaphragm pump shown partly in section.

DETAILED DESCRIPTION OF THE DRAWING

Numeral 10 designates a pump head. The pump head 10 contains a diaphragm chamber 12. The diaphragm chamber 12 is closed by a diaphragm 14 made of PTFE (polytetrafluorethylene). The diaphragm 14 is clamped between an upper portion of the pump head 16 and an annular lower portion of the pump head 18. A base 20 having a central aperture 22 is located under the lower portion of the pump. The pump head 10 is surrounded by pump head heating means 24 and is heated thereby. A heat insulation layer 26 is arranged around the pump head heating means 24. The pump head 10 is supported on a platform 30 through studs 28. The platform 30 is located on an electric driving motor 32.

The diaphragm chamber 12 is connected to a gas inlet 36 through a check valve 34 opening in inlet direction and is connected to a gas outlet 40 through a check valve (38) opening in outlet direction. Both check valves 34 and 38 are arranged in the heatable part of the pump head 10.

The diaphragm 14 is fixedly connected to a connecting rod 46 by means of two clamping plates 42 and 46. To this end the diaphragm 14 is clamped between the clamping plates 42 and 44. The clamping plates 42,44 are tightened to each other and to the connecting rod 46 by means of a flat head screw 48. The connecting rod 46 extends through the aperture 22 and is driven for reciprocating motion by the motor 32 through a crank drive 50. The reciprocating motion is associated with a certain swivelling movement.

In order to ensure sufficient heating also in the area of the clamping plate 42, which is in heat conductive communication with the pump head 10 and the pump head heating means 24 only through the poorly heat conductive and thin PTFE-diaphragm 14, the connecting rod 46 is heated. For this purpose heating means 52 is provided in the connecting rod 46. This heating means 52 is formed by a heating cartridge. Further on a temperature sensor 54 is arranged in the connecting rod 46. The temperature sensor 54 is connected to a controller 56. The controller 56 controls the additional heating means 52 arranged in the connecting rod 46. A section 58 of the connecting rod 46 adjacent to the diaphragm and the clamping plates 42,44 is made of a material having a relatively high heat conductivity. In a prefered embodiment of the diaphragm pump this section 58 adjacent to the diaphragm is made of a well heat conducting AlMg-alloy. The section 60 of the connecting rod adjacent to the motor is made of a material having a relatively low heat conductivity. In the prefered embodiment of the diaphraghm pump this section 60 adjacent to the motor is made of a chrome steel tube. The heat conductivity of the chrome steel tube is reduced further by additional transverse bores 62.

The power for the heating means 52 arranged in the connecting rod 46 is supplied by leaf springs 64, only one of which can be seen in the FIGURE. The leaf springs 64 are U-shaped in a plane parallel to the plane of motion of the connecting rod 46 (or in a plane parallel to the paper plane in the FIGURE). One leg 66 of each leaf spring 64 is held electrically insulated at a stationary element 68 arranged on the platform 30 and is connected to a power supply 70. The other leg 72 of each leaf spring 64 is fixed electrically insulated to the connecting rod 46 by means of a block of insulating material 74 and is connected to the heating means 52 through a conductor 76.

The connection between the temperature sensor 54 arranged in the connecting rod 46 and the controller 56 is established through leaf springs 78 in a similar way. The leaf springs 78 as well are U-shaped in a plane parallel to the plane of motion of the connecting rod 46 or are U-shaped in this plane. Only one of the leaf springs 78 can be seen in the FIGURE. The leaf springs 78 are arranged substantially in the plane of motion of the connecting rod 46, i.e. adjacent to the connecting rod 46 diametrically opposite the leaf springs 64 in the paper plane of the FIGURE. One leg 80 of each leaf spring 78 is held electrically insulated at a stationary element 82 arranged on the platform 30 and is connected to the controller 56 through a signal line 84. The other leg 86 of each leaf spring 78 is attached electrically insulated to the connecting rod 46 by means of an insulating block 74 and is connected to the temperature sensor 54 through a line 88. The leaf springs 64 and 78 are made of beryllium bronze.

In this way controlled heating of the connecting rod 46 and of the clamping plates 42,44 is accomplished. The heat dissipation through the connecting rod 46 is reduced. The temperature of the section 58 of the connecting rod 46 adjacent to the diaphragm and of the clamping plates 42 and 44 have to be controlled with temperature hysteresis as small as possible. The temperature of the pump head 10 and the parts getting into contact with the pumped gases, particularly the clamping plate 42, has to be higher than the dew point of the gases. This temperature which is controlled by the controller 56 is 250 degrees C. The maximum allowable temperature of the PTFE-diaphragm is only slightly higher than this controlled temperature.

The controlled heating of the connecting rod requires the measuring signals from the temperature sensor 54 to be transmitted from the moved connecting rod 46 to the stationary controller 56, and also the heating power has to be supplied to the heating means 52 moved with the connecting rod 46. This is enabled by the leaf springs 64 and 78 which absorbs the vertical movement of the connecting rod 46 in the FIGURE, as well as the horizontal movement of the connecting rod 46 in the FIGURE. Using beryllium bronze as material for the leaf springs 64 and 78 ensures long useful life under continuously oscillating loads at 25 cycles per second, for example.

The pump head 10 has an additional port 90 for zero gas. This additional port 90 communicates with the gas outlet 40 through a check valve 92, a T-shaped element 94 and the check valves 34 and 38 with closed shut-off valve 104. The check valve 92 of the additional port 90 is arranged in a heated area 96 of the pump head 10 inside the pump head heating means 24.

The pump head 10 has a further additional port 98 for a back washing gas. The additional port 98 for the back washing gas communicates with the gas inlet 36 upstream of the T-shaped element 94 through a check valve 100 and a T-shaped element 102 when shut-off valve 104 is closed. Shut-off valve 104 is provided in the main gas path intermediate the openings of back washing gas and zero gas. The shut-off valve 104 is arranged to be operated pneumatically through a port 106. The check valve 100 of the additional port 98 and the shut-off valve 104 are also provided in the heated area 96 of the pump head 10. In this way all check valves and shut-off valves 92,100 or 104, respectively, are heated with the pump head 10 and the required temperature is maintained.

We claim:

1. A heatable diaphragm pump for gases, for example for the pumping of smoke gases which are to be analysed for noxious components, comprising (a) a pump head (10) with a diaphragm chamber (12) which is closed by a flexible diaphragm (14) and which communicates with a gas inlet (36) through a check valve (34) opening in inlet direction, and communicates with a gas outlet (40) through a check valve (38) opening in outlet direction, (b) a driving motor (32)

(c) a connecting rod (46) which is fixedly connected to the diaphragm (14) through clamping plates (42,44) and which is arranged to be driven for reciprocatory motion by the driving motor (32) through a crank drive (50), (d) insulation means (26,28) for thermic insulation of the pump head (10), and (e) pump head heating means (24) for heating the pump head (10)

characterized in that (f) heating means (52) are provided in the connecting rod (46) in addition to the pump head heating means (24).

2. A heatable diaphragm pump as set forth in claim 1, characterized in that (a) a temperature sensor (54) is arranged in the connecting rod (46), and (b) the temperature sensor (54) is connected to a controller (56) which controls the additional heating means (52) arranged in the connecting rod (46).

3. A heatable diaphragm pump as set forth in claim 2, characterized in that a section (58) of the connecting rod (46) adjacent to the diaphragm, and the clamping plates (42,44) are made of a material having a relatively high heat conductivity and a section (60) of the connecting rod adjacent to the motor is made of a material having a relatively low heat conductivity.

4. A heatable diaphragm pump as set forth in claim 3, characterized in that the section (60) of the connecting rod (46) adjacent to the motor is formed by a tube.

5. A heatable diaphragm pump as set forth in claim 4, characterized in that the tube has lateral apertures in order to increase its heat resistance.

6. A heatable diaphragm pump as set forth in claim 5, characterized in that the power for the heating means (52) arranged in the connecting rod (46) is supplied through leaf springs (64), which are U-shaped in a plane parallel to the plane of motion of the connecting rod (46), one leg (66) of each leaf spring being held electrically insulated at a stationary element (68) and being connected to a power supply (70), and the other leg (72) of each leaf spring being attached electrically insulated to the connecting rod (46) and being connected to the heating means (52).

7. A heatable diaphragm pump as set forth in claim 2, characterized in that the connection between the temperature sensor (54) arranged in the connecting rod (46)

and and the controller (56) is established by leaf springs (78), which are U-shaped in a plane parallel to the plane of motion of the connecting rod (46), one leg (80) each of these leaf springs being held electrically insolated at a stationary element (82) and being connected to the controller (56), and the other leg (86) each of these leaf springs being attached electrically insolated to the connecting rod (46) and being connected to the temperature sensor (54).

8. A heatable diaphragm pump as set forth in claim 6, characterized in that the leaf springs (64,78) are made of beryllium bronze.

9. A heatable diaphragm pump as set forth in claim 7, characterized in that the leaf springs (64,78) are made of beryllium bronze.

10. A heatable diaphragm pump as set forth in claim 1, characterized in that (a) The pump head (10) has a shut-off valve (104) arranged between the gas inlet (36) and the check valve (34) opening in inlet direction, (b) the pump head (10) has an additional port (90) for a zero gas, with a check valve (92) opening in inlet direction, (c) the additional port (90) is connected to the gas outlet (40) through the check valves (92,34 and 38), when the shut-off valve (104) is closed, and (d) the check valve (92) of the additional port (90) is arranged in the heatable area (96) of the pump head (10).

11. A heatable diaphragm pump as set forth in claim 1, characterized in that (a) the pump head (10) has an additional port (98) with a check valve (100) for a backwashing gas, (b) the additional port (98) is connected to the gas inlet (36) through a check valve (100), when the shut-off valve (104) is closed, (c) the shut-off valve (104) is provided in the the gas inlet (36) downstream of the opening of the additional port (98) into the gas inlet (36), and (d) the check valve (100) of the additional port and the shut-off valve (104) are provided in a heated area (96) of the pump head (10).

12. A heatable diaphragm pump as set forth in claim 10, characterized in that the shut-off valve (104) is arranged to be operated pneumatically.

13. A heatable diaphragm pump as set forth in claim 11, characterized in that the shut-off valve (104) is arranged to be operated pneumatically.

* * * * *